343-909
2/16/88 XR 4,725,847 SR

United States Patent [19]
Poirier

[11] Patent Number: 4,725,847
[45] Date of Patent: Feb. 16, 1988

[54] REFLECTOR ANTENNA HAVING SIDELOBE NULLING ASSEMBLY WITH METALLIC GRATINGS

[75] Inventor: J. Leon Poirier, Chelmsford, Mass.

[73] Assignee: The United States of America as represented by the Secretary of the Air Force, Washington, D.C.

[21] Appl. No.: 870,562

[22] Filed: Jun. 4, 1986

[51] Int. Cl.[4] ..... H01Q 19/19
[52] U.S. Cl. ..... 343/840; 343/839; 343/909; 343/912
[58] Field of Search ..... 343/756, 761, 839, 840, 343/909, 912, 915

[56] References Cited

U.S. PATENT DOCUMENTS

| | | | |
|---|---|---|---|
| 2,555,123 | 5/1951 | Gardner | 250/33.65 |
| 2,820,221 | 1/1958 | Broussaud | 343/909 |
| 2,935,746 | 5/1960 | Marston et al. | 343/912 |
| 2,989,748 | 10/1960 | Doundoulakis et al. | 343/781 |
| 3,019,430 | 1/1962 | Pedersen et al. | 343/12 |
| 3,101,473 | 8/1963 | Fenlon, Jr. | 343/760 |
| 3,196,442 | 7/1965 | Leffelman et al. | 343/765 |
| 3,412,405 | 11/1968 | Crotty et al. | 343/777 |
| 3,445,850 | 5/1969 | Stegen | 343/727 |
| 3,882,503 | 5/1975 | Gamara | 343/100 R |
| 4,086,591 | 4/1978 | Siwiak et al. | 343/18 A |
| 4,169,268 | 9/1979 | Schell et al. | 343/909 |
| 4,274,098 | 3/1980 | Renau et al. | 343/781 |
| 4,312,002 | 1/1982 | Stewart | 343/761 |
| 4,376,940 | 3/1983 | Miedema | 343/840 |
| 4,631,547 | 12/1986 | Jacavanco | 343/840 |

FOREIGN PATENT DOCUMENTS

| | | | |
|---|---|---|---|
| 1297708 | 6/1969 | Fed. Rep. of Germany | 343/782 |
| 107604 | 7/1982 | Japan | 343/761 |

OTHER PUBLICATIONS

"Controlled Surface Distortion Effects", Proceedings of 1984 Antenna Applications Symposium, Sep. 1984, by Daniel Jacavanco.

*Primary Examiner*—William L. Sikes
*Assistant Examiner*—Doris J. Johnson
*Attorney, Agent, or Firm*—Richard J. Donahue; Donald J. Singer

[57] ABSTRACT

A reflector antenna having an adaptive nulling assembly. The assembly comprises a disk shaped mounting plate having a shaft aligned with the rotational axis thereof and passing through the main reflector focusing surface. An absorber of electromagnetic energy is affixed to the disk and a microwave grating of metallic elements is positioned on the surface of the absorber. The amplitude of the nulling signal is controlled by rotating the assembly, and the phase of the nulling signal is controlled by the varying height of the grating above the reflector. Additional nulling elements can be used to null multiple interference sources.

6 Claims, 6 Drawing Figures

REFLECTOR ANTENNA HAVING SIDELOBE NULLING ASSEMBLY WITH METALLIC GRATINGS

STATEMENT OF GOVERNMENT INTEREST

The invention described herein may be manufactured and used by or for the Government for governmental purposes without the payment of any royalty thereon.

BACKGROUND OF THE INVENTION

The present invention relates to electromagnetic wave reception and transmission apparatus, and more particularly to a reflector type antenna having one or more mechanical assemblies disposed on the reflective surface thereof for achieving high quality adaptive nulling throughout the sidelobe region of the antenna.

Various techniques have been used in the past for nulling or suppressing selected sidelobes in directional antenna systems. One such technique which is particularly suitable for phased array systems involves the electronic control or measurement of the individual element signals of the array to ultimately produce a null or nulls in the antenna pattern. This form of adaptive nulling, however, requires costly components and complex algorithms, often requires long signal processing times, and is not usually suitable for reflector type antennas.

Another known adaptive nulling technique for reducing sidelobe interference in reflector antennas and phased arrays is called sidelobe cancellation. It involves combining the signal from the main antenna with a signal derived from an auxiliary antenna, which is suitably adjusted in amplitude and phase. Such auxiliary antenna systems, however, require high precision components and complex microwave circuitry to achieve adequate system performance.

In U.S. Pat. No. 4,376,940 issued to H. Miedema on Mar. 15, 1983, there is disclosed an antenna arrangement for suppressing sidelobes by mechanical means, in which the arrangement consists of a pair of auxiliary antennas located at the edges of the reflector antenna such that, when the energy from the main and auxiliary antennas are combined in a hybrid coupler and associated circuitry, certain sidelobes are suppressed. An alternative embodiment of the invention involves laterally offsetting edge segments of the reflector to produce a radiation pattern which is phased opposite to the selected sidelobes to be suppressed.

A problem associated with sidelobe nulling by adjusting the edge segments of a reflector is that the energy reflected from the vicinity of the edge or rim of the reflector to the feed horn is purposely made much lower than the energy from the center region of the reflector to the feed horn. This is done in order to reduce overall sidelobes. Therefore such edge-located antenna adjusting techniques require relatively large reflecting areas to provide a signal of adequate amplitude for nulling. Also, once the physical size of the auxiliary segments has been selected, only sidelobes whose gains are nearly equal to the gain of the auxiliary segments can be nulled effectively. It is also apparent that retrofitting existing antennas to include auxiliary antennas or adjustable edge reflectors or segments could be prohibitively expensive.

The concept and practicality of adaptive nulling in a reflector antenna by means of at least two small and adjustable reflective disks disposed on the focusing surface of the antenna is disclosed and claimed in U.S. Pat. No. 4,631,547 of Daniel Jacavanco, issued Dec. 23, 1986 and entitled "Reflector Antenna Having Sidelobe Suppression Elements". This concept is also disclosed by Mr. Jacavanco in his paper entitled "Controlled Surface Distortion Effects", which appears in the Proceedings of 1984 Antenna Applications Symposium, September 1984. A signal is produced at the antenna feed output which is a function of the energy reflected by the disks as well as that reflected by the reflector. By adjusting the spacing between the disks and the reflector surface, the phase and amplitude of the resulting nulling signal can be varied relative to the antenna signal. This technique allows intentional or unintentional sources of interference to be nulled or eliminated. However, two interacting disks are needed to achieve amplitude as well as phase control.

Nulling with only one disk can only be achieved in those regions where the sidelobe signal is within one or two decibels of the signal level provided by the single disk. If the sidelobe signal from the antenna and the signal from the single disk are not approximately equal, then to achieve nulling, the size of the disk must be increased or decreased.

OBJECTS AND SUMMARY OF THE INVENTION

It is therefore an object of this invention to provide apparatus for modifying the radiation pattern of a reflector type antenna.

It is a further object of the present invention to provide a reflector type antenna having means for placing nulls at selected angular locations within its radiation pattern.

It is another object of the present invention to provide a directional antenna with identical sidelobe nulling characteristics in the transmission and reception modes.

It is yet another object of the present invention to provide a directional antenna with sidelobe suppression capability which does not degrade the response of the main beam.

It is yet another object of the present invention to provide a directional antenna having sidelobe suppression capability which is inexpensive to achieve.

It is yet another object of the present invention to provide both amplitude and phase nulling in the radiation pattern of a reflector type antenna with the use of a single sidelobe nulling assembly.

These and other objects of the invention are realized in a preferred embodiment of the invention by means of a novel sidelobe nulling assembly. The sidelobe nulling assembly comprises a disk-shaped mounting plate having a shaft aligned with the rotational axis thereof and passing through the main reflector focusing surface. An absorber of electromagnetic energy is affixed to the disk and a microwave grating made up of a grid of parallel wires or of thin metallic strips is positioned on the exposed surface of the absorber. The nulling assembly is oriented to direct electromagnetic energy into the feed horn of the main antenna. The reflectivity of the nulling assembly is a function of the relative orientation of the incident electric field to the microwave grating on the nulling assembly. Thus the amplitude of the signal reflected from the nulling assembly is controlled by rotating the assembly, and its phase is controlled by adjusting the spacing between the grating on the nulling assembly and the main reflector surface. Independent adjustment of both the phase and the amplitude of the cancellation signal produces high quality nulls in any desired direction in the sidelobe region of the antenna.

This structure and technique are particularly well suited for earth-satellite communications systems, microwave relay links, bistatic radar intrusion sensors, space based reflector antennas and other similar applications. Additional nulling assemblies can be used to provide additional nulls in the antenna pattern as needed to counteract multiple interfering sources.

BRIEF DESCRIPTION OF THE DRAWINGS

The foregoing and additional objects, advantages and features of the present invention will be more fully understood from the following detailed description when read together with the accompanying drawings, in which.

DESCRIPTION OF THE PREFERRED EMBODIMENTS

Figure 1:
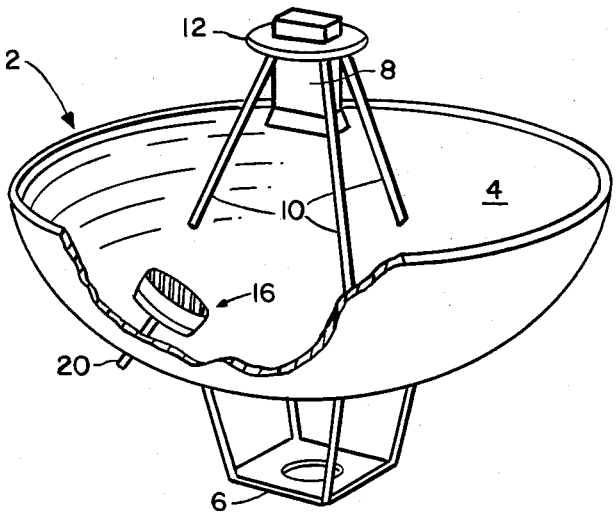
FIG. 1 is a pictorial representation of a reflector type antenna having the sidelobe suppressing or nulling assembly of the present invention.

Referring now to FIG. 1 of the drawings, there is shown a reflector type antenna 2 having a reflector 4 attached to a mounting base 6. A feed horn 8 is supported at the central axis or boresight of antenna 2 by tripod 10 and ring 12. Ring 12 and tripod 10 permit precision mechanical alignment of the feed horn 8 with the reflector 4. A part of reflector 4 has been broken away in the drawing to better show the novel nulling assembly 16 of the present invention that is supported by its control rod or shaft 20 which protrudes through the reflector 4.

Figure 2:
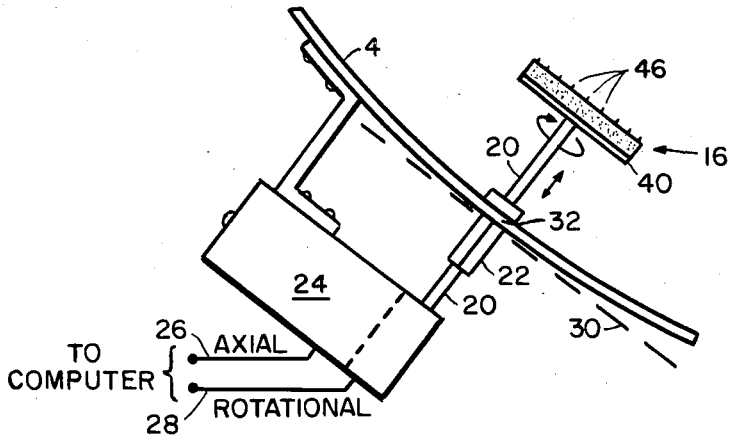
FIG. 2 is a side view of the portion of the reflector antenna of FIG. 1 which contains the sidelobe nulling assembly.

FIG. 2 depicts a side view of the portion of the reflector antenna 2 in the vicinity of the nulling assembly 16. For manual adjustment, motor drive 24 is not required and may be omitted. Control shaft 20 is held in place by collet chuck 22, which permits adjustment of the nulling assembly 16 at desired distances above the surface of the reflector 4 as well as rotation of the control shaft 20. It will be appreciated that in certain applications, it may be desireable to automatically adjust the height or penetration of nulling assembly 16 above the surface of reflector 4, and also the angular position or orientation of nulling assembly 16 about the axis of its mounting and control shaft 20. This is accomplished by connecting shaft 20 to a computer-controlled motor 24 positioned on the back surface of reflector 4, and providing axial and rotational control signals to the motor 24 via leads 26 and 28 respectively. In this case, collet chuck 22 can be left loosened and used as a sleeve bearing or can be removed, leaving a clearance hole for control shaft 20 through the reflector 4.

It will be seen that nulling assembly 16 is mounted on reflector 4 such that the reflecting surface of assembly 16 is parallel to the tangent plane 30 at the point 32 where the shaft 20 passes through the reflector 4. Stated differently, the shaft 20, which is aligned with the rotational axis of nulling assembly 16, i.e., the axis through the center of the disk and orthogonal to the plane of the disk, bisects the angle formed by a line from the focus of the feed horn of antenna 2 to the point 32 and a line from that point 32 parallel to the reflector boresight axis.

Figure 3A:
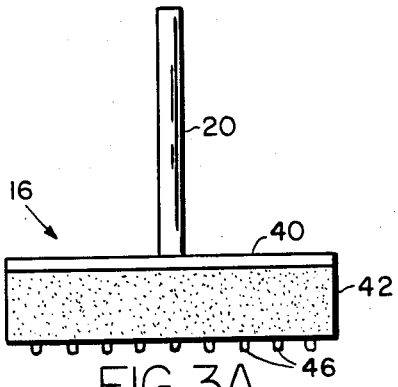
FIGS. 3A, 3B and 3C are top, front and side orthogonal views respectively of the variable gain and phase nulling assembly of the present invention.
Figure 3B:
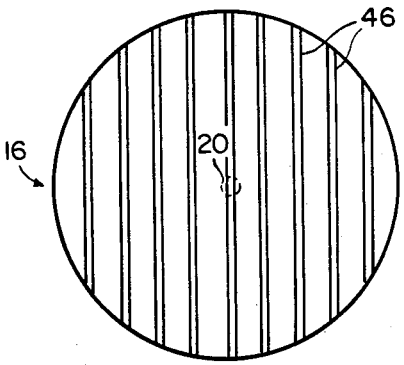
Figure 3C:
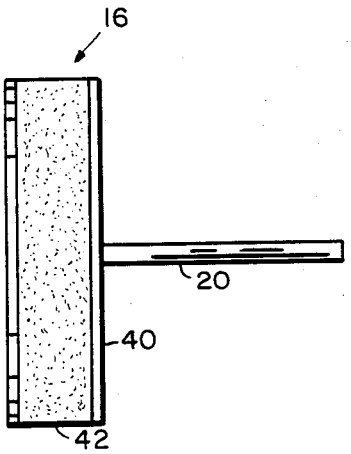

FIGS. 3A, 3B and 3C provide detailed top, front and side views of the nulling assembly 16 of the present invention. It will be seen that control rod or shaft 20 is attached orthogonally to a disk-shaped metallic holding plate 40, and an absorber 42 of electromagnetic energy is affixed to plate 40. Absorber 42 can be the type in which carbon particles are dispersed in a foamed structure, similar to the material marketed by Advanced Absorber Products Co. and also by Emerson and Cuming, Inc. Other microwave absorber materials may also be used.

A series of parallel spaced metallic elements 46 are affixed to the free surface of absorber 42 at a spacing (discussed below) of 0.1 wavelengths at the frequency of operation of the antenna. Metallic elements 46 are preferrably a parallel grid of wires of circular cross section, but an alternative embodiment might consist of conducting strips etched from a foil-clad dielectric sheet, or other similar configuration.

The theory of the reflection from microwave gratings, such as the grating formed by the metallic elements 46, is well known and is described in such books as the Antenna Engineering Handbook, Johnson and Jasik, 2nd Edition, McGraw Hill Book Co., N.Y., 1984. Although there is no sharp cutoff to performance with varying metallic element spacing, it is generally accepted that spacings larger than 0.1 wavelength result in a poor reflection from the grating. As an example, the reflection coefficients for a grating of wires of 0.01 wavelength diameter spaced 0.1 and 0.2 wavelengths apart are about 0.95 and 0.60 respectively. Also, spacings that are too large result in secondary reflection lobes for high angles of incidence.

In operation, the reflection of electromagnetic energy provided by the grating assembly formed of elements 46 depends on the orientation of the incident electric field relative to the metallic wires or strips 46 on the surface of nulling assembly 16. When the impinging electric field is parallel to the strips 46 and the grid or grating spacing is small, about 0.1 wavelength or less, the grating appears nearly solid and the power reflection coefficient $R_1$ is nearly equal to one. When the electric field is perpendicular to the wires or strips 46, the grating structure appears nearly transparent and $R_2$ is nearly equal to zero. For intermediate angles, reflection coefficient R falls between the two extremes $R_1$ and $R_2$.

The extreme values $R_1$ and $R_2$ depend on the size of the wires or strips 46 and their spacing relative to the wavelength of operation of the antenna. A spacing of 0.1 wavelengths or less insures that $R_1$ is nearly equal to one. The minimum spacing is not critical and spacings of 0.01 wavelength result in only a slight increase above zero in $R_2$.

The ratio $A_p/A$, where $A_p$ and A are the area of the nulling assembly and the projected area of reflector 4 respectively, should be chosen to be about equal to the peak sidelobe level of the highest sidelobe to be cancelled. Then any sidelobe can be cancelled by rotating assembly 16 to match the amplitude and by adjusting the spacing between assembly 16 and reflector surface 4 to provide a nulling signal of opposite phase to that of the sidelobe signal.

The absorber 42 is placed behind microwave grating elements 46 to prevent the reflection of the electromagnetic wave that passes through the grating from holding plate 40. The wave is attenuated as it passes from the grating elements 46 to holding plate 40 and is attenuated again upon reflection from plate 40 back to the grating 46. A one-way attenuation of 10–15 dB will result in a value of $R_2$ between 0.001 and 0.01, so that $R_2$ is approximately equal to zero. An absorber 42 thickness of one half wavelength is adequate.

Without the absorber 42, there would be total reflection from plate 40 and the amplitude of the reflected signal would be independent of rotation. This would negate the variable amplitude feature of the assembly, and therefore, an absorber of microwave energy is necessary.

The number of such nulling assemblies 16 determines the number of nulls that can be inserted into the antenna pattern simultaneously. Only one nulling assembly 16 is required for each null.

In practice, a null is established in the direction of an interferring source by systematically adjusting the axial and rotational positions of the nulling assembly until the antenna output is minimized. This can be accomplished by an associated computer which has as an input the received level of the antenna output and provides control signals to the motor 24 via leads 26 and 28 respectively, to systematically minimize the antenna output power. This procedure ensures the proper adjustment of nulling assembly 16.

Figure 4:
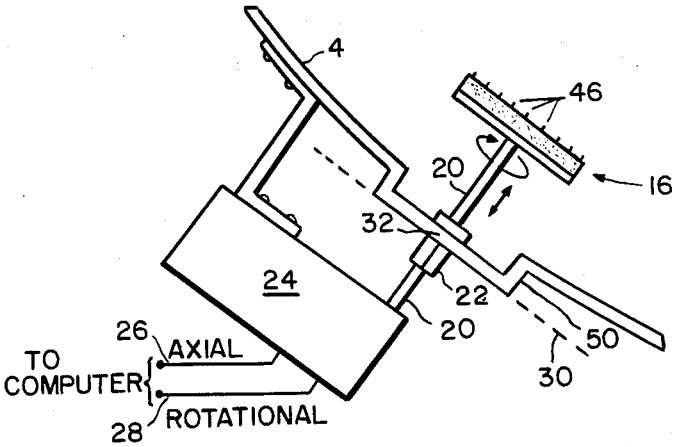
FIG. 4 is a sideview of another embodiment of the mounting of the sidelobe nulling assembly to the reflector antenna.

FIG. 4 shows an alternative configuration for mounting the nulling assembly 16 on the reflector 4 surface. Here, a recess or cavity 50 is provided in the main reflector 4 such that nulling assembly 16 may be recessed so as to make the grating of wires 46 substantially flush with the main reflector surface 4 when nulling assembly 16 is fully retracted. This alternative embodiment will minimize secondary effects on the mainbeam and sidelobes of the main reflector.

Although the invention, as herein disclosed has been described with reference to certain specific embodiments thereof, other structures than those herein disclosed which embody the principles of this invention will be obvious to those skilled in the art and are intended to be embraced by the appended claims.

What is claimed is:

1. In a directional antenna of the type having a main reflector of electromagnetic energy and a feed positioned near the focal point of said main reflector, apparatus comprising:

at least one electromagnetic energy nulling assembly disposed on the focusing surface of said main reflector;

said energy nulling assembly comprising a plate, an electromagnetic energy absorbing material having a first surface and an opposed second surface, said first surface of said absorbing material being affixed to said plate, and a single planar grating formed of a plurality of metallic elements spaced in parallel, said grating being affixed to said second surface of said absorbing material;

said nulling assembly further comprising a shaft on said plate which passes through said focusing surface of said main reflector;

said grating of said nulling assembly being substantially parallel to the tangent plane formed at the point on said main reflector where said shaft of said nulling assembly passes through said main reflector;

said shaft of said nulling assembly being rotatable about its longitudinal axis to vary the orientation of said grating with respect to the electric field of electromagnetic energy impinging thereon;

said shaft of said nulling assembly being moveable along its longitudinal axis to vary the height of said grating above the focusing surface of said main reflector.

2. Apparatus as defined in claim 1 wherein said plurality of metallic elements have a spacing between 0.15 and 0.005 wavelength of the frequency of operation of said antenna.

3. Apparatus as defined in claim 2 wherein each of said plurality of metallic elements are wires of circular cross section.

4. Apparatus as defined in claim 3 and further comprising:

drive means attached to said shaft of said nulling assembly for rotating said shaft of said nulling assembly and for varying the height of said nulling assembly above the focusing surface of said main reflector in response to electrical signals applied to said drive means.

5. Apparatus as defined in claim 4 and further including additional ones of said nulling assemblies disposed on the focusing surface of said main reflector.

6. Apparatus as defined in claim 2 wherein said plurality of metallic elements are strips of foil formed on an insulative substrate.

* * * * *